US007854476B1

(12) United States Patent
Liu

(10) Patent No.: US 7,854,476 B1
(45) Date of Patent: Dec. 21, 2010

(54) BABY SEAT

(76) Inventor: Cheh-Kang Liu, 5F., No. 41, Alley 3, Lane 91, Sec. 4, Pa Te Rd., Taipei (TW)

( * ) Notice: Subject to any disclaimer, the term of this patent is extended or adjusted under 35 U.S.C. 154(b) by 0 days.

(21) Appl. No.: 12/581,685

(22) Filed: Oct. 19, 2009

(51) Int. Cl.
*A63G 9/10* (2006.01)

(52) U.S. Cl. ..... 297/181; 297/250.1; 297/256.11; 297/254; 297/219.12; 297/344.12

(58) Field of Classification Search ..... 297/181, 297/250.1, 254, 256.11, 256.15, 219.12, 297/344.12; D6/611, 359
See application file for complete search history.

(56) References Cited

U.S. PATENT DOCUMENTS 1,508,697 A * 9/1924 Junker ..... 297/332
1,739,366 A * 12/1929 Lang ..... 297/37
4,586,747 A * 5/1986 Taylor ..... 297/256.11
4,695,092 A * 9/1987 Hittie ..... 297/219.12
D294,099 S * 2/1988 Bromberg et al. ..... D6/611
4,854,638 A * 8/1989 Marcus et al. ..... 297/256.11
5,112,104 A * 5/1992 De Giacomi ..... 297/229
5,137,335 A * 8/1992 Marten ..... 297/485
5,147,109 A * 9/1992 Jolly ..... 297/217.4
5,183,311 A * 2/1993 Meeker et al. ..... 297/151
D347,756 S * 6/1994 Robertson ..... D6/501
5,354,118 A * 10/1994 Barry ..... 297/181
D356,449 S * 3/1995 Frye ..... D6/359
5,551,749 A * 9/1996 Reher et al. ..... 297/219.12
6,033,019 A * 3/2000 Hession-Kunz et al. .. 297/250.1
6,126,240 A * 10/2000 Tse ..... 297/461
6,832,813 B2 * 12/2004 Tomas et al. ..... 297/250.1
7,422,276 B2 * 9/2008 Flannery ..... 297/16.2

* cited by examiner

*Primary Examiner*—Laurie K Cranmer
(74) *Attorney, Agent, or Firm*—Jackson IPG PLLC; Demian K. Jackson

(57) ABSTRACT

A baby seat includes a seat shell equipped with a folding stand and straps for fastening to an adult chair, a seat back shell having two smoothly arched top protrusions at the top side to show the configuration of the head of an animal, two armrests connected between the seat back shell and the seat shell and a soft seat cushion configured to exhibit the configuration of an animal and divided into a seat back portion that carries a design and a seat portion, the seat cushion having a sleeve extended from the top side thereof for sleeving onto the seat back shell and two flexible tie cords respectively affixed to two opposite lateral sides thereof with stitches for insertion through insertion slots on the seat shell to tie the seat cushion to the seat shell, the sleeve having two curved portions fitting the smoothly arched top protrusions of the seat back shell to enhance positioning stability of the seat cushion on the seat back shell.

1 Claim, 9 Drawing Sheets

BABY SEAT

BACKGROUND OF THE INVENTION

1. Field of the Invention

The present invention relates to baby seat and more particularly to such a baby seat which has its seat back shell configured to show the shape of animal for positively securing one of a set of animal-shaped seat cushions selected by the user.

2. Description of the Related Art

Conventional chairs commonly have a broad area seat not suitable for the sitting of an enfant or young child. There are baby seats specifically designed for babies. A regular baby seat commonly comprises a seat shell, a seat back and adjustable straps for securing the set shell and the seat back to the seat and back of an adult chair for adult so that a baby can be carried in the baby seat on the adult chair. However, a baby may be not willing to sit on a baby seat that is attached to an adult chair. When sitting on a baby seat at an adult chair, the baby will become unpleasant soon, troubling the parents.

SUMMARY OF THE INVENTION

The present invention has been accomplished under the circumstances in view. It is therefore the main object of the present invention to provide a baby seat, which secures an animal-shaped seat cushion positively and allows quick replacement of the animal-shaped seat cushion with other substitute designs to attract the baby.

To achieve this and other objects of the present invention, a baby seat comprises a seat shell, straps for securing the seat shell to an adult chair, a folding stand provided at the bottom side of said seat shell, a seat back shell two smoothly arched top protrusions raised from two ends of a top side thereof to show the configuration of the head of an animal, two armrests connected between the seat back shell and the seat shell at two opposite lateral sides and a soft seat cushion configured to exhibit the configuration of an animal and divided into a seat back portion that carries a design and a seat portion, the seat cushion having a sleeve extended from the top side thereof for sleeving onto the seat back shell and two flexible tie cords respectively affixed to two opposite lateral sides thereof with stitches for insertion through insertion slots on the seat shell to tie the seat cushion to the seat shell, the sleeve having two curved portions fitting the smoothly arched top protrusions of the seat back shell to enhance positioning stability of the seat cushion on the seat back shell.

DETAILED DESCRIPTION OF THE INVENTION

Figure 1:
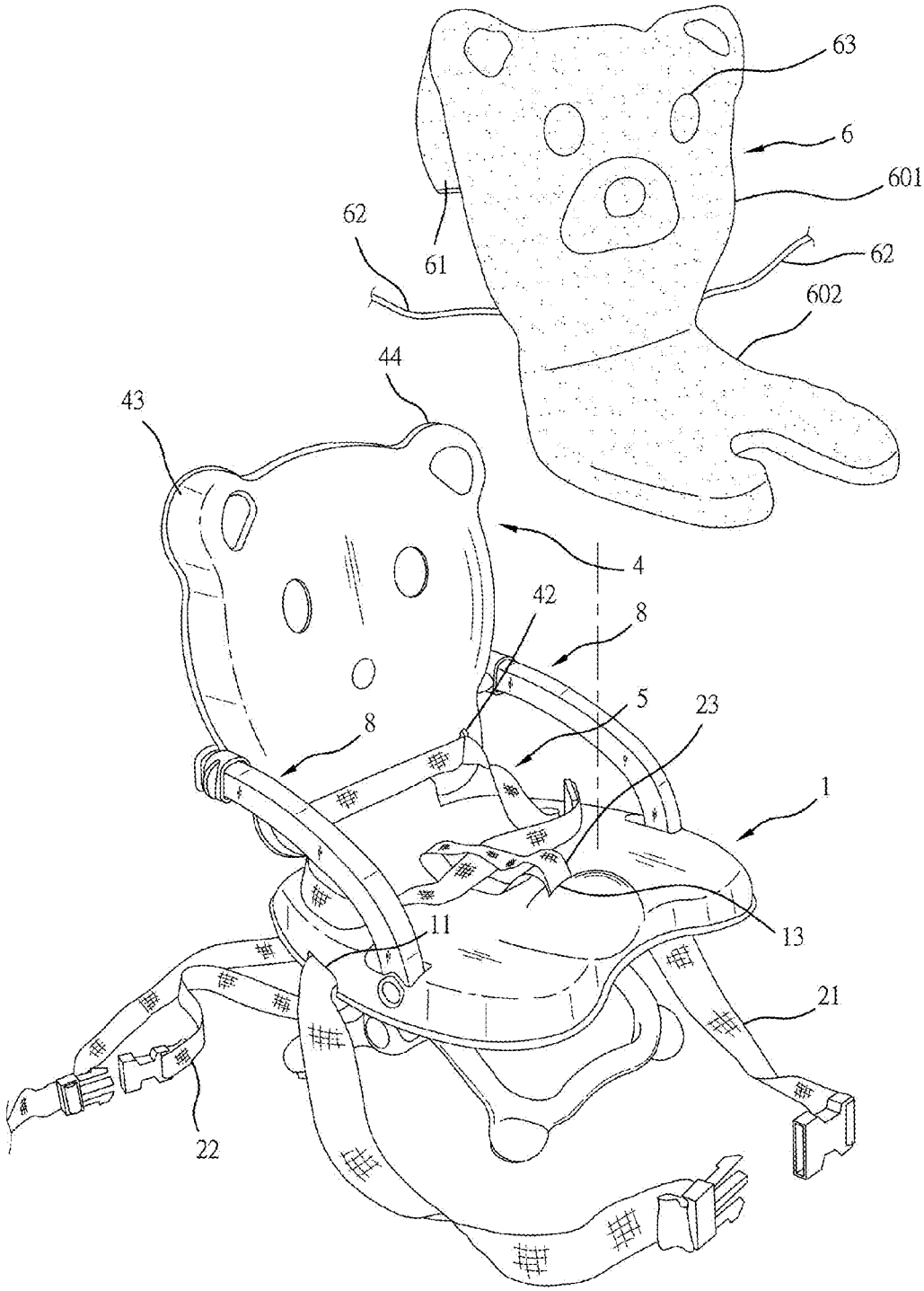
FIG. 1 is an exploded view of a baby seat in accordance with the present invention.
Figure 2:
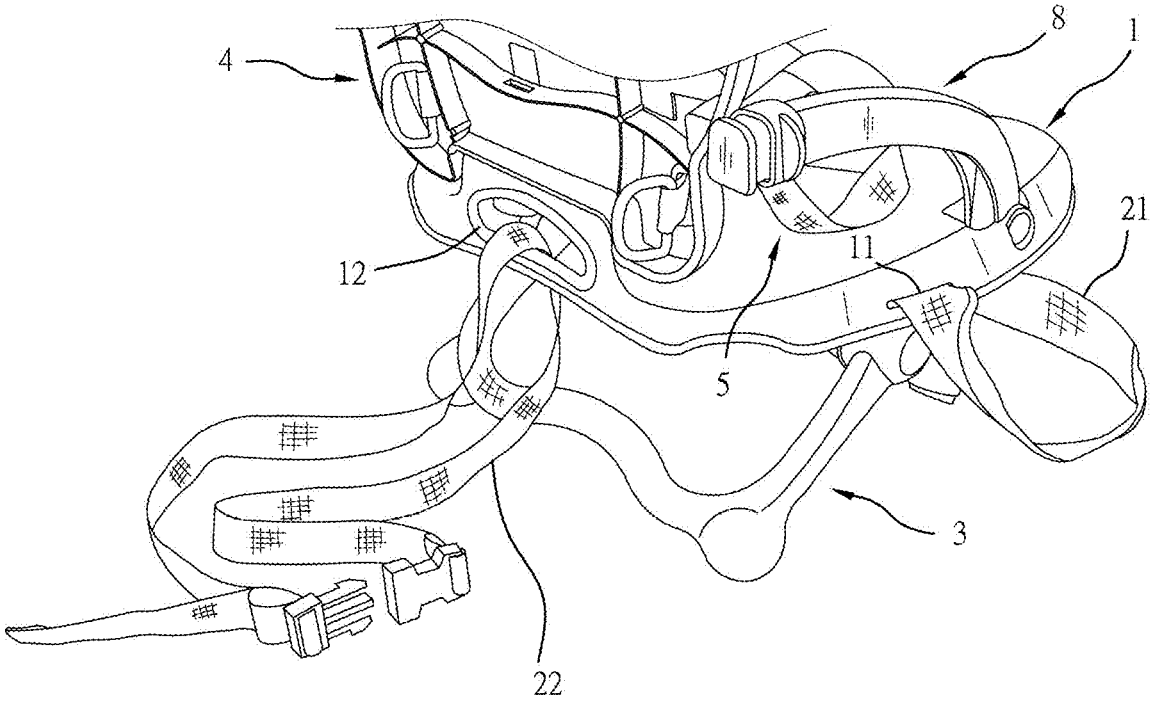
FIG. 2 is a back elevation in an enlarged scale of a part of the baby seat in accordance with the present invention.
Figure 3:
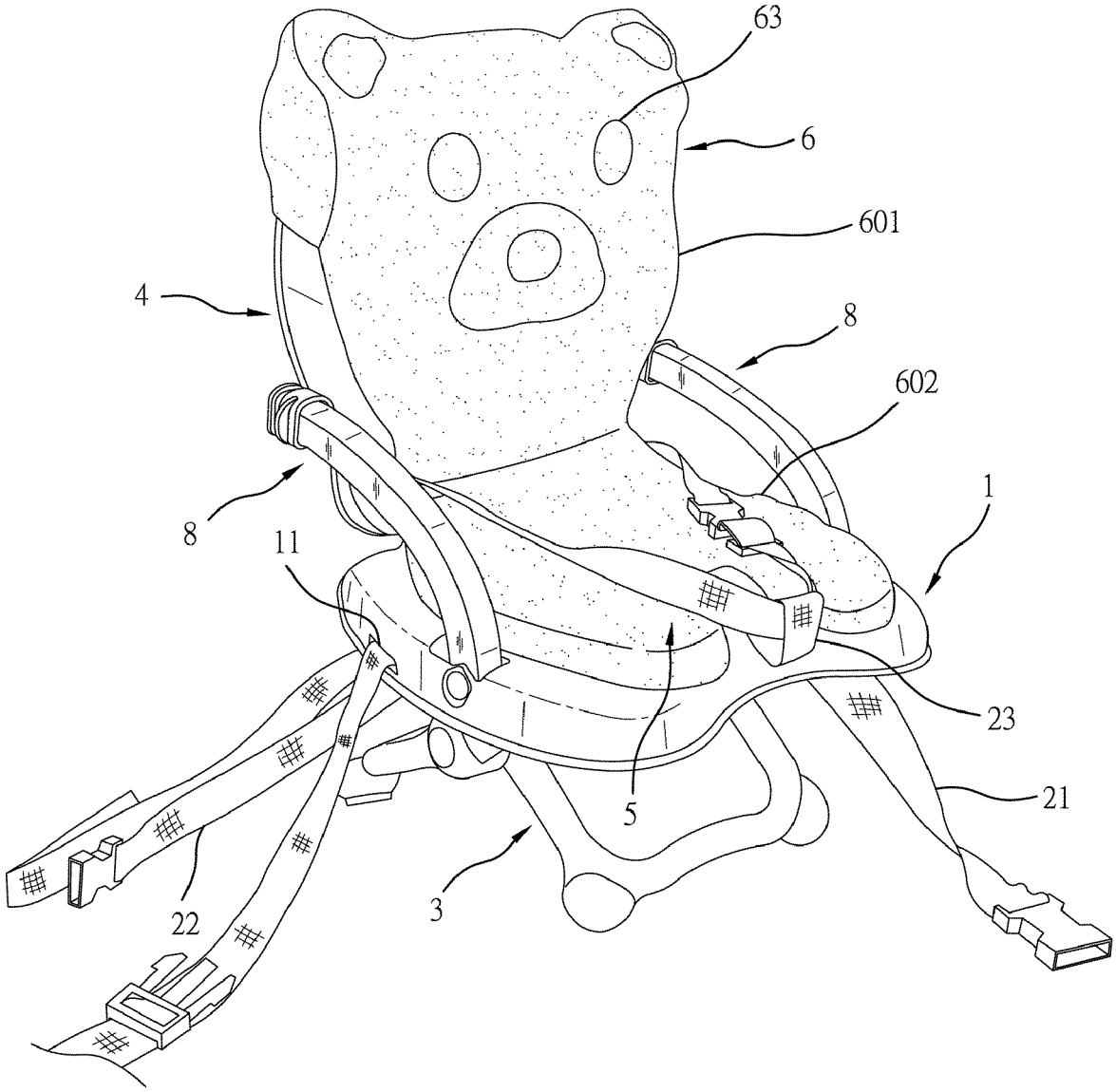
FIG. 3 is an oblique front elevation of the baby seat in accordance with the present invention.
Figure 6:
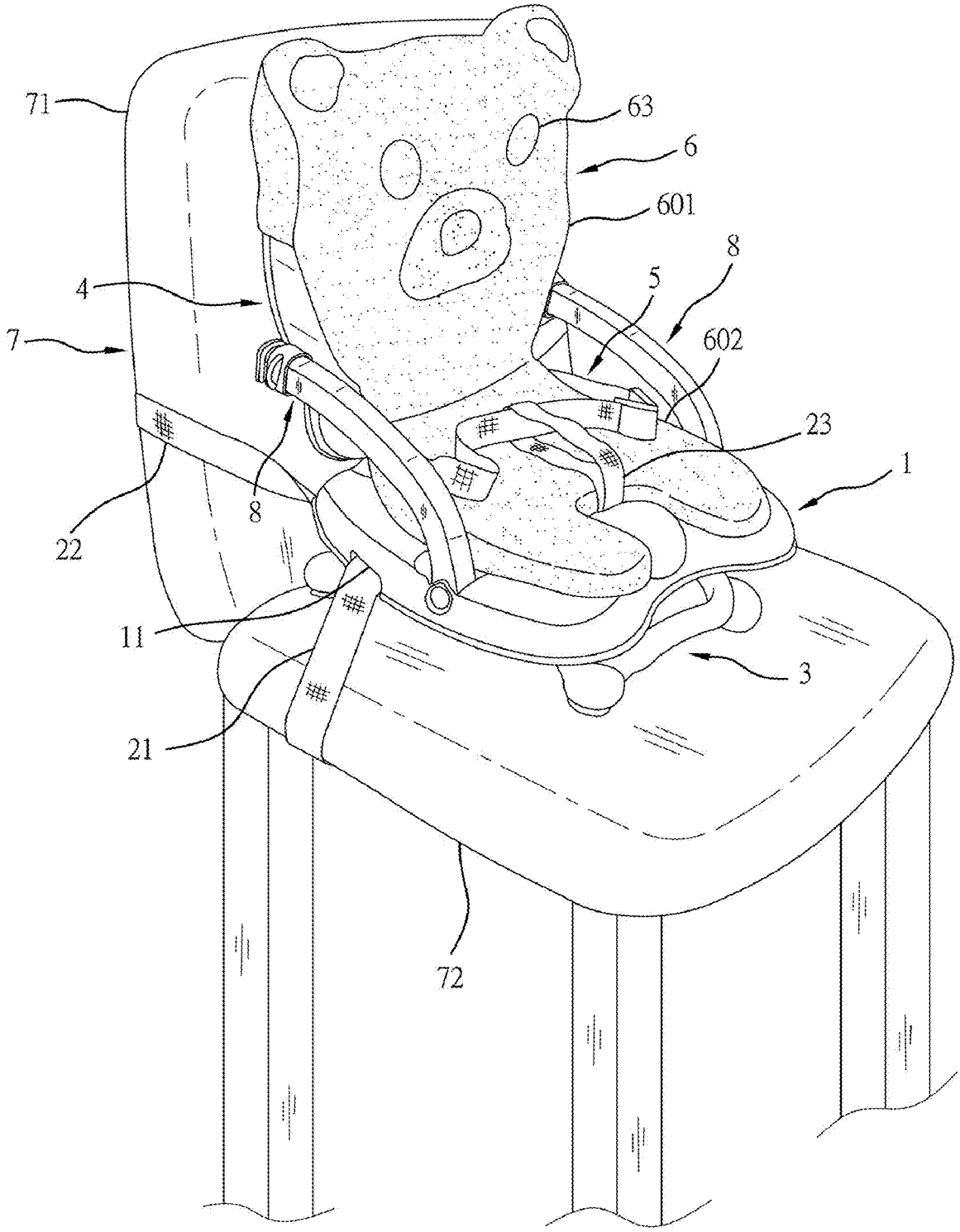
FIG. 6 is another applied view of the present invention, showing the baby seat fastened to an adult chair and the folding stand of the baby seat in the collapsed position.
Figure 7:
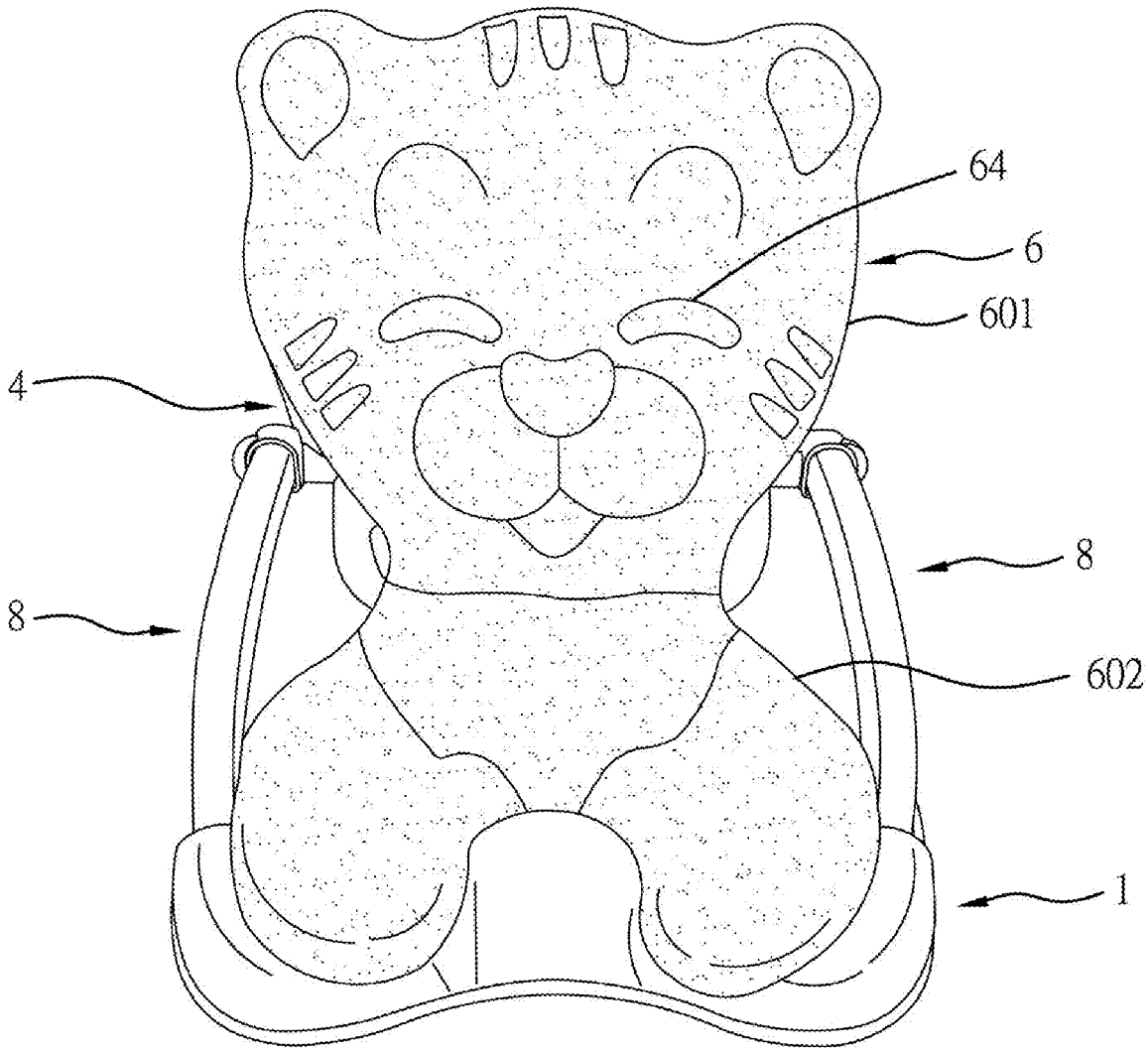
FIG. 7 shows an alternate form of the seat cushion according to the present invention.
Figure 8:
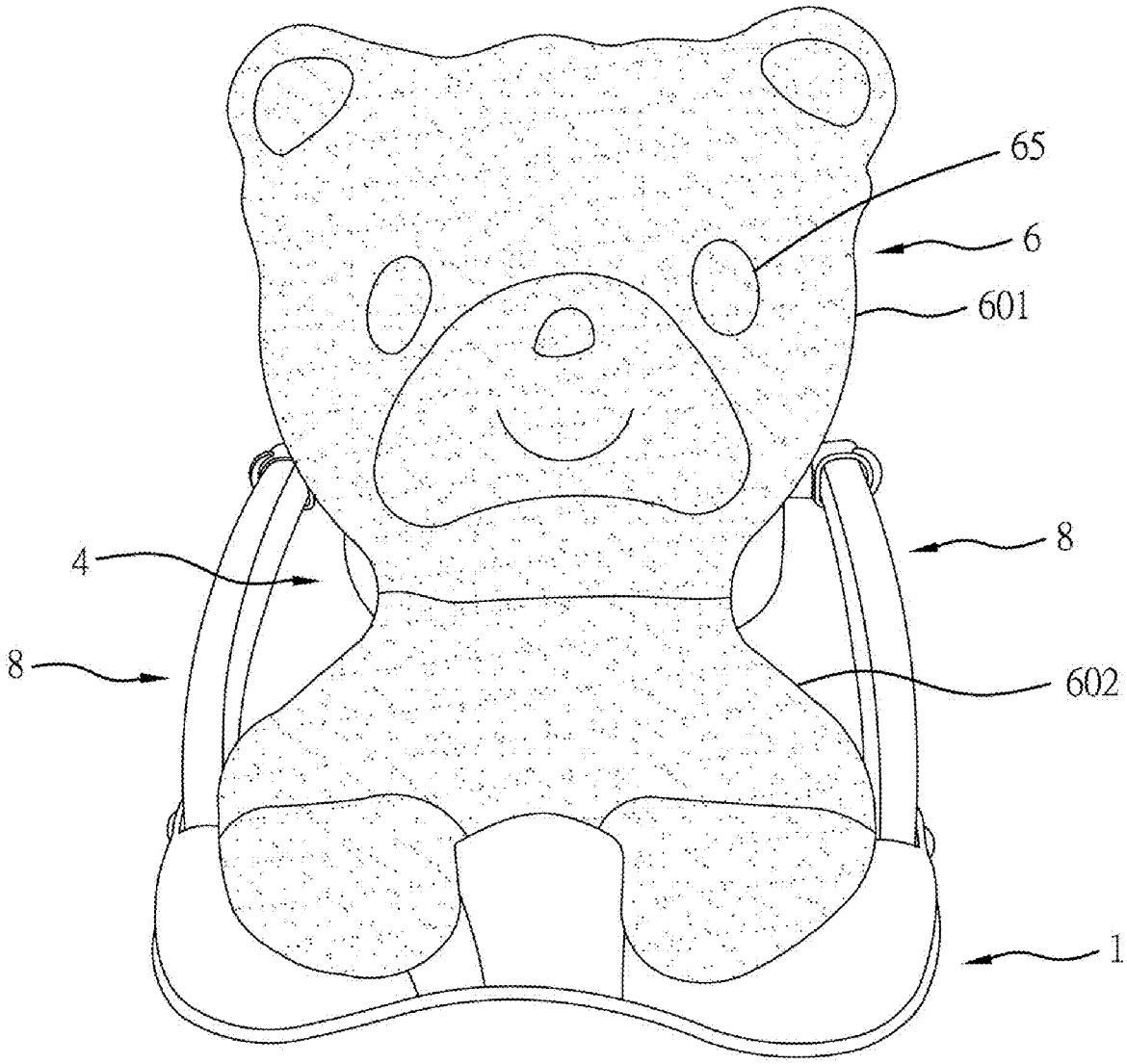
FIG. 8 shows another alternate form of the seat cushion according to the present invention.
Figure 9:
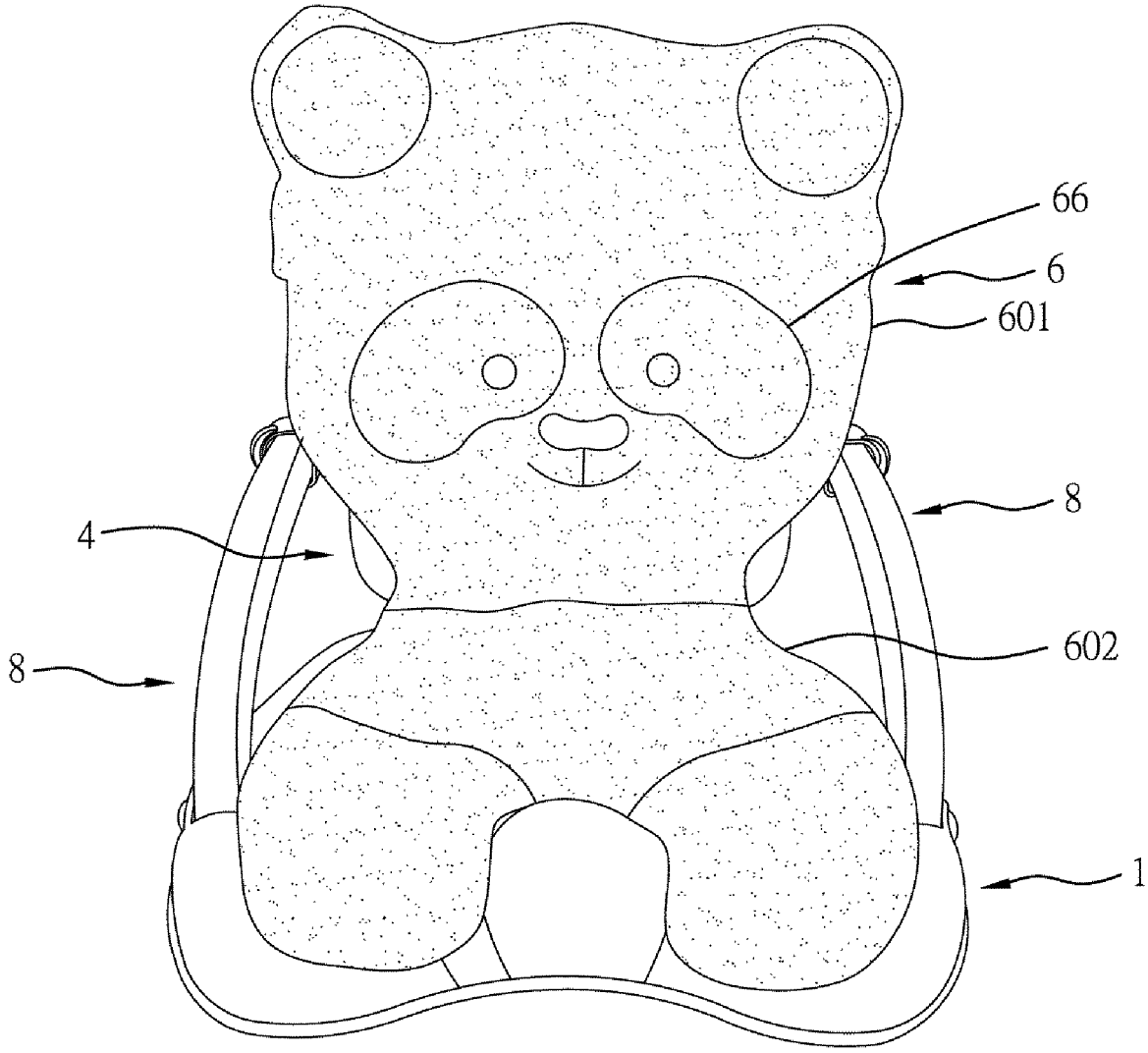
FIG. 9 shows still another alternate form of the seat cushion according to the present invention.

Referring to FIGS. 1~6, a baby seat in accordance with the present invention is shown comprising:

a seat shell 1, which has an insertion slot 11 on each of two opposite lateral sides thereof for the mounting of a first adjustable strap 21, a rear locating hole 12 located on the back side thereof for the mounting of a second adjustable strap 22 (see FIG. 2) and a front locating hole 13 located on the front side thereof for the mounting of a front strap 23;

a folding stand 3, which is provided at the bottom side of the seat shell 1 and foldable between an extended position and a collapsed position (see FIG. 6);

a seat back shell 4, which has two insertion slots 42 bilaterally disposed near the bottom side thereof for the insertion of a safety belt 5;

two armrests 8 connected between the seat back shell 4 and the seat shell 1 at two opposite lateral sides; and a seat cushion 6, which is prepared from a soft material and divided into a seat back portion 601 that carries a design 63 and a seat portion 602, having a sleeve 61 extended from the top side thereof (see FIGS. 1 and 4) for sleeving onto the seat back shell 4 (see FIGS. 3 and 4) and two flexible tie cords 62 respectively affixed to two opposite lateral sides thereof with stitches for insertion through the insertion slots 11 of the seat shell 1 to tie the seat cushion 6 to the seat shell 1.

Figure 5:
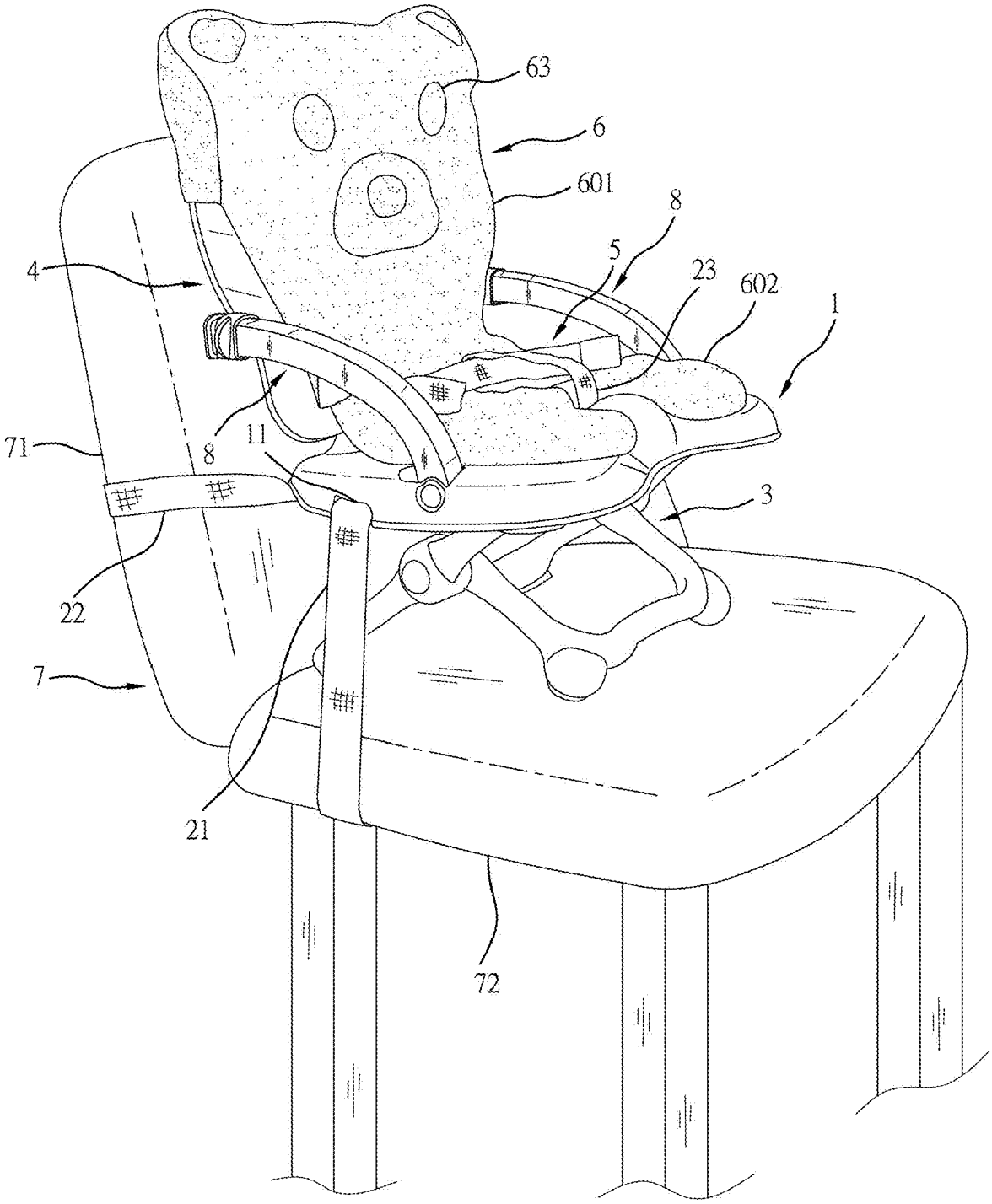
FIG. 5 is an applied view of the present invention, showing the baby seat fastened to an adult chair and the folding stand of the baby seat in the extended position.

Either the folding stand 3 is set in the extended position or the collapsed position, the seat shell 1 can be fastened to a chair 7 having a seat 72 and a back 71. FIG. 5 shows the baby seat fastened to the chair 7 with the folding stand 3 in the extended position. FIG. 6 shows the baby seat fastened to the chair 7 with the folding stand 3 in the collapsed position. When mounting the baby seat on the chair 7 with the folding stand 3 set either in the extended position or the collapsed position, fasten the first adjustable strap 21 to the seat 72 of the chair 7 (see FIGS. 5 and 6), and then fasten the second adjustable strap 22 to the back 71 of the chair 7, and the use the safety belt 5 and the front strap 23 to secure the baby to the seat cushion 6.

Figure 4:
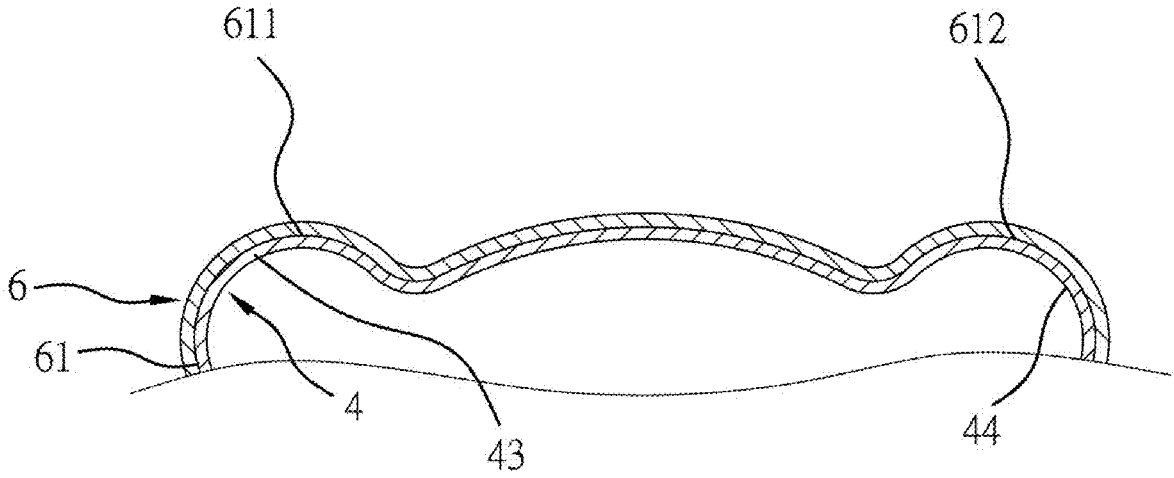
FIG. 4 is a sectional view in an enlarged scale of a part of the baby seat in accordance with the present invention.

The main features of the present invention are outlined hereinafter:

The seat back shell 4 has two smoothly arched top protrusions 43 and 44 raised from the two ends of the top side thereof, showing the configuration of the head of an animal (see FIGS. 1 and 4). The sleeve 61 of the seat cushion 6 has two curved portions 611 and 612 fitting the smoothly arched top protrusions 43 and 44 of the seat back shell 4 (see FIG. 4). Further, the seat cushion 6 is configured to exhibit the configuration of an animal. When the sleeve 61 is sleeved onto the seat back shell 4, the two curved portions 611 and 612 of the sleeve 61 are respectively attached to the smoothly arched top protrusions 43 and 44 of the seat back shell 4, enhancing positioning stability of the seat cushion 6 on the seat back shell 4. By means of the animal configuration of the seat cushion 6, the baby seat attracts a baby to sit on it.

Further, the seat cushion 6 can be made carrying any of a variety of designs 63, 64, 65 or 66 (see FIGS. 3, 7, 8 and 9) to show the shape of one of various different animals. The seat cushion 6 can also be configured to show the configuration of an animal. Differently configured seat cushions may be prepared for selection by consumers. In any shape, the seat cushion 6 must have a sleeve 61 with two curved portions 611 and 612 mounting on the seat back shell 4 stably. A consumer can purchase multiple seat cushions 6 having the same configuration but carrying different designs 63-66 (see FIGS. 3, 7, 8 and 9) or multiple differently configured seat cushions for selective use. Thus, the user can change the installed seat cushion with a different design when desired, satisfying the baby's demand.

In conclusion, the invention provides a baby seat that has the following advantages:

1. The seat back shell 4 has two smoothly arched top protrusions 43 and 44 raised from the two ends of the top side thereof, showing the configuration of the head of an animal, and the sleeve 61 of the seat cushion 6 has two curved portions 611 and 612 fitting the smoothly arched top protrusions 43 and 44 of the seat back shell 4. When the sleeve 61 of the seat cushion 6 is sleeved onto the seat back shell 4, the two curved portions 611 and 612 of the sleeve 61 are respectively attached to the smoothly arched top protrusions 43 and 44 of the seat back shell 4, enhancing positioning stability of the seat cushion 6 on the seat back shell 4.
2. The user can selectively fasten one of a set of seat cushions 6 carrying different designs 63-66 (see FIGS. 3, 7, 8 and 9) to the seat back shell 4 and the seat shell 1 and can make a change conveniently when desired, showing a variation.

What is claimed is:

1. A baby seat, comprising;

a seat shell, said seat shell comprising an insertion slot on each of two opposite lateral sides thereof for the mounting of a first adjustable strap, a rear locating hole located on a back side thereof for the mounting of a second adjustable strap and a front locating hole located on a front side thereof for the mounting of a front strap;

a folding stand provided at a bottom side of said seat shell and foldable between an extended position and a collapsed position;

a seat back shell, said seat back shell comprising two insertion slots bilaterally disposed near a bottom side thereof for the insertion of a safety belt;

two armrests connected between said seat back shell and said seat shell at two opposite lateral sides; and a seat cushion prepared from a soft material and divided into a seat back portion that carries a design and a seat portion, said seat cushion comprising a sleeve extended from a top side thereof for sleeving onto said seat back shell and two flexible tie cords respectively affixed to two opposite lateral sides thereof with stitches for insertion through the insertion slots of said seat shell to tie said seat cushion to said seat shell;

wherein:

said seat back shell comprises two smoothly arched top protrusions raised from two ends of a top side thereof to show the configuration of the head of an animal; said sleeve of said seat cushion comprises two curved portions fitting the smoothly arched top protrusions of said seat back shell; said seat cushion is configured to exhibit the configuration of an animal.

* * * * *